US005378081A

United States Patent [19]

Swisher, Jr.

[11] Patent Number: 5,378,081

[45] Date of Patent: Jan. 3, 1995

[54] MILLING MACHINE WITH FRONT-MOUNTED CUTTER

[76] Inventor: George W. Swisher, Jr., 1500 Dorchester Dr., Oklahoma City, Okla. 73210

[21] Appl. No.: 197,089

[22] Filed: Feb. 16, 1994

[51] Int. Cl.[6] ..... E01C 23/12

[52] U.S. Cl. ..... 404/90; 299/39; 404/84.05

[58] Field of Search ..... 404/84.05, 87, 90, 91, 404/93, 94; 299/39, 73, 75, 76, 78; 51/174, 176; 172/122

[56] References Cited

U.S. PATENT DOCUMENTS 4,704,045 11/1987 Taylor et al. ..... 404/90
4,878,713 11/1989 Zanetis ..... 404/90 X
4,909,575 3/1990 Lupton ..... 299/39
5,203,615 4/1993 Zanetics ..... 404/90 X

*Primary Examiner*—Ramon S. Britts
*Assistant Examiner*—James A. Lisehora
*Attorney, Agent, or Firm*—Dunlap, Codding & Lee

[57] ABSTRACT

A milling machine having a rotary cutter drum which is movable both horizontally and vertically into operating position. The milling machine includes a mobile frame, a cutter rack, a cutter housing, a cutter drum and a pair of cutter skids. The cutter rack is mounted for vertical sliding movement to the front end of the frame. A pair of hydraulic cylinders are provided between the frame and the cutter rack to move the cutter rack to an operating elevation. In turn, the cutter housing is mounted for horizontal sliding movement to the cutter rack. A hydraulic cylinder is provided to move the cutter housing horizontally to a milling position. The cutter skids are positioned on opposite sides of the cutter housing to bear on a surface being milled and to support the cutter housing and cutter during the milling operation. Two hydraulic cylinders are provided on each side of the cutter housing to move the cutter housing vertically to set the cutter drum to a cutting depth. The rotary cutter drum is transversely mounted within the cutter housing with a portion of the cutter drum protruding from the bottom of the cutter housing. The frame is supported on front and rear wheels by legs which telescope under electro-hydraulic control to adjust the elevation of the frame.

18 Claims, 1 Drawing Sheet

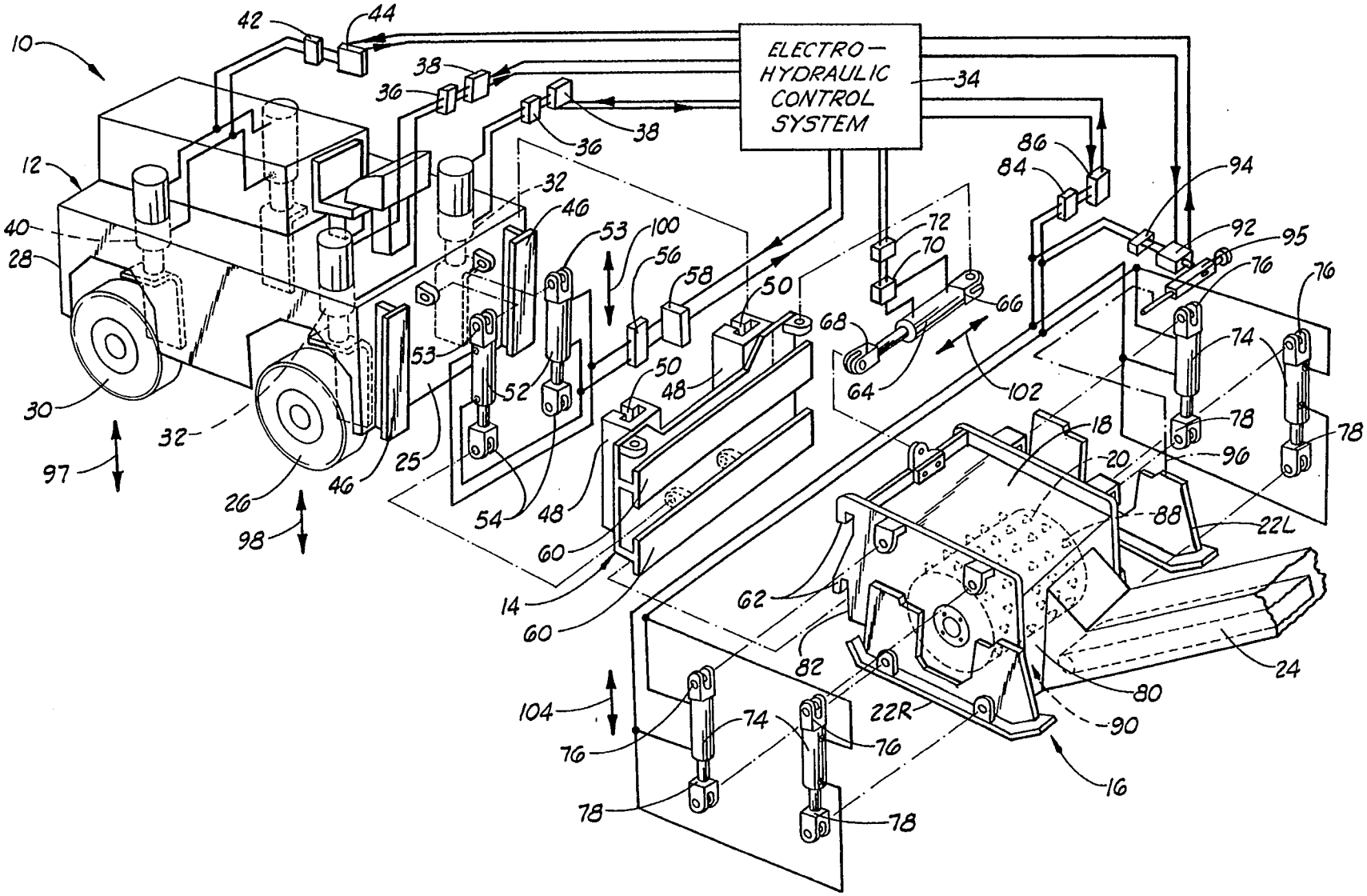
ELECTRO-
HYDRAULIC
CONTROL
SYSTEM

MILLING MACHINE WITH FRONT-MOUNTED CUTTER

BACKGROUND OF THE INVENTION

1. Field of the Invention

The present invention relates generally to construction machines for cutting and shaping an upper portion of surfaces such as roads, pavement and runways.

2. Description of Related Art

Various types of milling or planing machines having rotary cutters are known in the art. In the case of many of these machines, the cutter is mounted between the front and rear wheels or tracks. For example, U.S. Pat. No. 4,139,318, issued to Jakob et al., discloses an apparatus for planing a paved roadway in which the planer assembly is mounted beneath the frame in an intermediate position.

By mounting the cutting assembly under the frame, however, the vertical movement of the cutting assembly is limited by the elevation of the frame above the surface being milled. Raising the elevation of the frame to accommodate a higher cutter assembly position causes the machine to have a higher center of gravity. Of course, a higher center of gravity means greater instability for the machine.

SUMMARY OF THE INVENTION

The present invention is a milling machine for cutting and shaping an upper portion of a surface such as a road, a roadbed, a pavement or a runway. The milling machine includes a mobile frame, a cutter rack, a cutter housing, a cutter drum and a pair of cutter skids.

The cutter rack is mounted to the front of the frame to slide vertically under the control of a pair of hydraulic rack cylinders. In turn, the cutter housing is mounted to the cutter rack to slide horizontally by operation of a horizontal hydraulic cylinder.

The cutter skids are located on opposite sides of the cutter housing to bear on the surface to be milled and to support the cutter housing during the milling operation. The cutter skids are connected to the cutter housing by four vertical hydraulic cylinders, two on each side of the cutter housing.

The milling is performed by the rotatable cutter drum, which is transversely mounted within the cutter housing. A portion of the cutter drum protrudes through a cutter opening in the bottom of the cutter housing to engage and cut the surface as the cutter drum is rotated.

One object of the present invention is to provide a milling machine with a front-mounted cutter assembly so that the frame of the machine may be relatively low to the ground to give the machine better stability.

Another object of the present invention is to provide a milling machine which is adjustable in elevation at multiple points.

Yet another object of the present invention is to provide a milling machine having a cutter assembly which can be operated with hold down pressure to transfer weight from the frame to the cutter assembly.

Still another object of the present invention is to provide a milling machine having a cutter assembly which can be moved in both horizontal and vertical directions.

Other objects, features and advantages of the present invention are apparent from the following detailed description when read in conjunction with the accompanying drawings and appended claims.

BRIEF DESCRIPTION OF THE DRAWINGS

FIG. 1 is a partly diagrammatical, exploded, perspective view of a milling machine constructed in accordance with the present invention.

DETAILED DESCRIPTION OF THE PREFERRED EMBODIMENTS

Referring to FIG. 1, shown therein and designated by the general reference numeral 10 is a milling machine, which includes a mobile frame 12, a cutter rack 14 and a cutter assembly 16.

The cutter assembly 16 typically comprises a cutter housing 18, a rotatable cutter drum 20, a pair of cutter skids 22R and 22L and a conveyor 24. The cutter skids 22R and 22L are positioned on the left and right sides of the cutter housing 18, respectively, to support the cutter assembly 16 upon the surface being milled.

The frame 12 has a front end 25, front wheels 26, a rear end 28 and rear wheels 30. Each front wheel 28 is mounted to the frame 12 with a front leg 32, which telescopes to change the elevation of the frame 12 from the surface being milled. The front legs 32 are typically hydraulic and are controlled by an electro-hydraulic control system 34 carried on board the frame 12.

Electro-hydraulic control systems for construction vehicles such as milling machines are well known in the art. Any conventional control system which functions in a manner consistent with the components and operations described herein may be utilized with the milling machine 10.

It should be appreciated that the machine 10 includes a conventional hydraulic system which is operatively connected to the hydraulic valves, hydraulic cylinders and other hydraulic components of the machine 10. The operator of the machine 10 controls the hydraulic system through the electro-hydraulic control system 34 and other suitable electric, hydraulic and electro-hydraulic components.

A control valve 36 and a locking valve 38 are provided between each front leg 32 and the electro-hydraulic control system 34. Each control valve 36 actuates the corresponding front leg 32 to change the elevation of the frame 12 in response to the electro-hydraulic control system 34. When in a locked mode, each locking valve 38 prevents operation of the corresponding control valve 36 to set the elevation of the frame 12.

It should be appreciated that the two front legs 32, with the corresponding control valves 36 and locking valves 38, operate independently from one another. In this manner, the front sides of the frame 12 may be set to different elevations.

In similar fashion, each rear wheel 30 is mounted to the frame 12 with a corresponding rear leg 40. Only one control valve 42 and locking valve 44, however, are provided to control both rear wheels 30. Thus the rear legs 40 are operated in concert to adjust the elevation of the frame 12 at the rear 26 of the machine 10.

A pair of vertical rack guides 46 protrude from the front 25 of the frame 12. The rack guides 46 are typically T-shaped in cross-section and extend substantially from the top to the bottom of the front 25 of the frame 12.

In order to slidingly mount the cutter rack 14 to the frame 12, the cutter rack 14 has a pair of rack followers 48, which are shaped and spaced to mate with the rack guides 46 of the frame 12. Each rack follower 48 has T-shaped channel 50, which is sized to receive a corresponding one of the rack guides 46.

A pair of rack cylinders 52 are provided to move the cutter rack 14 up and down at the front 25 of the frame 12. Each rack cylinder 52 has one end 53 which is clevis-mounted to the front 25 of the frame 12 and a reciprocatable rod 54 at opposite end which is clevis-mounted to the cutter rack 14.

The rack cylinders 52 are operatively connected through a control valve 56 and a locking valve 58 to the electro-hydraulic control system 34. The control valve 56 actuates movement of the rack cylinder rods 54 and the locking valve 58 is utilized to lock the rack cylinder rods 54 in position when a desired operating elevation for the cutter rack 14 is achieved.

A pair of spaced apart cutter housing guides 60 protrude from the cutter rack 14 across the front 62 of the cutter rack 14. The housing guides 60 are typically T-shaped in cross-section and substantially horizontal.

For mounting the cutter assembly 16 to the cutter rack 14, the cutter housing 18 includes two sets of hangers 62 located at both sides of the cutter housing 18. The cutter hangers 62 are shaped to fit over housing guides 60 of the cutter rack 14. The hangers 62 suspend the cutter housing 18 from housing guides 60 of the cutter rack 14 such that the cutter housing 18 may slide horizontally across the cutter rack 14.

A horizontal cylinder 64 is provided to move the cutter housing 18 back and forth across the cutter rack 14. The horizontal cylinder 64 has one end 66 which is clevis-mounted to the cutter rack 14 and a reciprocatable rod 68 at the opposite end which is clevis-mounted to the cutter housing 18.

The horizontal cylinder 64 is operatively connected to the electro-hydraulic control system 34 through a control valve 70 and a locking valve 72. The control valve 70 actuates the horizontal cylinder 64 to extend or retract the rod 68 to change the milling position of the cutter housing 18 and cutter drum 20 in the horizontal direction. The locking valve 72 may be set to prevent movement of the rod 68 once the cutter assembly 16 is in a desired milling position.

The cutter housing 18 is connected to the cutter skids 22R and 22L with four vertical cylinders 74. One end 76 of each vertical cylinder 74 is clevis-mounted to the cutter housing 18. At the opposite end, each vertical cylinder 74 includes a reciprocatable rod 78 which is clevis-mounted to the corresponding cutter skid 22R or 22L. On each side of the cutter housing 18, one of the vertical cylinders 74 is located toward the front 80 and the other vertical cylinder 74 is positioned toward the rear 82 of the cutter housing 18.

The vertical cylinders 74 are operatively connected to the electro-hydraulic control system 34 through a locking valve 84 and a control valve 86. The control valve 86 actuates the vertical cylinders 74 to extend or retract the rods 78 to change the cutting depth of the cutter assembly 16. The locking valve 84 may be set to prevent further movement of the rods 78 of the vertical cylinders 74 once a desired cutting depth is reached.

The operation of the electro-hydraulic control 34 is such that a regulated and adjustable hold down force may be applied through the vertical rack cylinders 74 to transfer a portion of machine 10 weight to the cutter assembly 16, if necessary, to hold the cutter drum 20 engaged with the material being cut.

The conveyor 24 is attached to the front of the cutter housing 18 and communicates with the interior of the cutter housing 18 to receive cuttings and debris produced by the milling operation. The conveyor 24 is typically enclosed to contain the cuttings, dust and debris. For simplicity of illustration, only a portion of the conveyor 24 is shown in the drawing figure.

The cutter drum 20 is mounted transversely within the cutter housing 18 and has a plurality of cutter teeth protruding from its outer periphery for cutting into the surface to be milled. One of the cutter teeth is designated by reference numeral 88 and is generally representative of the cutter teeth of the cutter drum 20.

The cutter teeth 88 may be constructed and arranged in various ways known in the art. For example, suitable devices for the cutter teeth 88 are disclosed in U.S. Pat. Nos. 4,139,318 and 4,335,921, which are hereby incorporated by reference.

It should be appreciated that the bottom of the cutter housing 18 has a cutter opening 90, through which a portion of the cutter drum 20 protrudes in order to engage and cut into the surface being milled. In addition, it should be understood that the cutter drum 20 moves up and down with the cutter housing 18. With the cutter skids 22R and 22L resting on the surface, the vertical cylinders 74 are utilized to raise and lower the cutter housing 18 and cutter drum 20 to adjust the cutting depth into the surface.

The cutting depth may be controlled manually by the operator through the electro-hydraulic control system 34, the locking valve 84 and the control valve 86. Alternatively, the cutting depth may be automatically maintained through an elevation control sensor 92, a locking valve 94 and sensor wand 95.

The elevation control sensor 92 and the sensor wand 95 are typically mounted to the side of the cutter housing 18. The sensor wand 95 measures the distance to the cutter skid 22L or to a grade wheel (not shown).

The electro-hydraulic control system 34 is connected to the sensor 92 to receive the distance measurements of the sensor 92. The electro-hydraulic control system 34 is also connected to the control valve 94 for automatically actuating the vertical cylinders 74.

If the distance measured by the sensor 92 does not correspond to a target cutting depth selected by the operator, the electro-hydraulic control system 34 actuates the control valve 94 to extend or retract the rods 78 of the vertical cylinders 74. In this manner, the cutting depth is continuously monitored and corrected to the target cutting depth.

Operation

As the operator steers the milling machine 10 over the surface, the cutter drum 20 is rotated to cut into the surface. The position and elevation of the machine 10 are controlled at multiple points.

As indicated by direction arrows 97, the elevation of the machine 10 at the rear 26 of the frame 12 is adjusted by extending or retracting the rear legs 40 through the electro-hydraulic control system 34 and the control valve 42. Similarly, the elevation of each front side of the frame 12 may be adjusted by extending or retracting (as indicated by direction arrows 98) the front legs 32 through the electro-hydraulic control system 34 and the control valves 36.

The operator may also adjust the operating elevation of the cutter housing 18 by raising or lowering the cutter rack 14. This is done by extending or retracting the rods 54 of the rack cylinders 52, as indicated by direction arrows 100.

The cutter rack 14 may also be moved horizontally by extending or retracting the rod 68 of the horizontal cylinder 64. The horizontal adjustment is indicated by direction arrows 102.

Finally, the cutting depth is controlled by extending or retracting the rods 78 of the vertical cylinders 74, as indicated by direction arrows 104. The cutting depth may be maintained manually by the operator or automatically with the sensor 92.

The milling machine 10 is typically operated by applying hold-down pressure with the rack cylinders 52, but allowing the rack cylinders 52 to float. In this manner, the cutter drum 20 engages the surface with sufficient pressure to cut into the surface and to transfer some weight from the machine 10 to the cutter drum 20. Allowing the rack cylinders 52 to float when the hold-down pressure is exceeded reduces the risk of mechanical breakdown of the cutter assembly 16 from extreme physical stress.

Changes may be made in the combinations, operations and arrangements of the various parts and elements described herein without departing from the spirit and scope of the invention as defined in the following claims.

What is claimed is:

1. A milling machine comprising:

a frame having a front end, a rear end and a pair of vertical rack guides mounted to the front end of said frame;

a cutter rack having a pair of front horizontal housing guides and a pair of rear rack followers, each rack follower being slidingly mounted to a corresponding one of the rack guides of said frame;

a cutter housing having a bottom with a cutter opening and a pair of rear housing followers, each housing follower being slidingly mounted to at least one of the housing guides of said cutter rack;

a cutter drum rotatably mounted within said cutter housing with a portion of said cutter drum protruding through the cutter opening of said cutter housing;

a pair of rack cylinders mounted between said frame and said cutter rack for vertically moving said cutter rack to an operating elevation over the surface; and a horizontal cylinder mounted between said cutter rack and said cutter housing for horizontally moving said cutter housing to a milling position.

2. The milling machine of claim 1 further comprising:

a locking valve connected to said rack cylinders for selectively locking said cutter rack at the operating elevation.

3. The milling machine of claim 1 further comprising:

a locking valve connected to said horizontal cylinder for selectively locking said cutter housing in the milling position.

4. The milling machine of claim 1 further comprising:

a pair of front wheels for supporting said frame over the surface being milled; and a pair of front legs connecting a corresponding one of said front wheels to said frame and being adapted to telescope for adjusting the elevation of said frame above the surface being milled.

5. The milling machine of claim 4 wherein said front legs are adapted to telescope independently.

6. The milling machine of claim 1 further comprising:

a pair of rear wheels for supporting said frame above the surface being milled; and a pair of rear legs, each one of said rear legs connecting a corresponding one of said rear wheels to said frame and being adapted to telescope for adjusting the elevation of said frame above the surface being milled.

7. The milling machine of claim 6 wherein said rear legs are adapted to telescope in concert.

8. The milling machine of claim 1 further comprising:

a pair of cutter skids located on opposite sides of said cutter housing to bear on a surface to be milled for supporting said cutter housing while said cutter drum is rotated to mill the surface; and a plurality of vertical cylinders mounted between said cutter housing and said cutter skids for vertically moving said cutter housing to dispose said cutter drum at a cutting depth for milling the surface.

9. The milling machine of claim 8 further comprising:

a locking valve connected to said vertical cylinders for selectively locking said cutter housing at the milling elevation for said cutter housing.

10. The milling machine of claim 8 further comprising:

a sensor mounted to said cutter housing and adapted to measure a distance corresponding to the cutting depth of said cutter drum; and electro-hydraulic means, operatively connected to said sensor and said vertical cylinders, for actuating said vertical cylinders to move said cutter housing to dispose said cutter drum at a predetermined target cutting depth in response to the distance measured by said sensor.

11. A milling machine comprising:

a frame having a front end, a rear end and a pair of vertical rack guides mounted to the front end of said frame;

a cutter rack having a pair of front horizontal housing guides and a pair of rear rack followers, each rack follower being slidingly mounted to a corresponding one of the rack guides of said frame;

a cutter housing having a bottom with a cutter opening and a pair of rear housing followers, each housing follower being slidingly mounted to at least one of the housing guides of said cutter rack;

a cutter drum rotatably mounted within said cutter housing with a portion of said cutter drum protruding through the cutter opening of said cutter housing;

a pair of rack cylinders mounted between said frame and said cutter rack for vertically moving said cutter rack to an operating elevation over the surface;

a horizontal cylinder mounted between said cutter rack and said cutter housing for horizontally moving said cutter housing to a milling position;

a pair of cutter skids located on opposite sides of said cutter housing to bear on a surface to be milled for supporting said cutter housing while said cutter drum is rotated to mill the surface; and a plurality of vertical cylinders mounted between said cutter housing and said cutter skids for vertically moving said cutter housing to dispose said cutter drum at a cutting depth for milling the surface.

12. The milling machine of claim 11 further comprising:

a locking valve connected to said rack cylinders for selectively locking said cutter rack at the operating elevation.

13. The milling machine of claim 11 further comprising:

a locking valve connected to said horizontal cylinder for selectively locking said cutter housing in the milling position.

14. The milling machine of claim 11 further comprising:

a pair of front wheels for supporting said frame over the surface being milled; and a pair of front legs connecting a corresponding one of said front wheels to said frame and being adapted to telescope for adjusting the elevation of said frame above the surface being milled.

15. The milling machine of claim 14 wherein said front legs are adapted to telescope independently.

16. The milling machine of claim 11 further comprising:

a pair of rear wheels for supporting said frame above the surface being milled; and a pair rear legs, each one of said rear legs connecting a corresponding one of said rear wheels to said frame and being adapted to telescope for adjusting the elevation of said frame above the surface being milled.

17. The milling machine of claim 16 wherein said rear legs are adapted to telescope in concert.

18. The milling machine of claim 11 further comprising:

a sensor mounted to said cutter housing and adapted to measure a distance corresponding to the cutting depth of said cutter drum; and electro-hydraulic means, operatively connected to said sensor and said vertical cylinders, for actuating said vertical cylinders to move said cutter housing to dispose said cutter drum at a predetermined target cutting depth in response to the distance measured by said sensor.

* * * * *